US008977176B2

(12) United States Patent
Shimizu et al.

(10) Patent No.: US 8,977,176 B2
(45) Date of Patent: Mar. 10, 2015

(54) FIXING APPARATUS PROVIDED WITH CLEANING UNIT USING CLEANING FABRIC

(75) Inventors: Yusuke Shimizu, Susono (JP); Kenji Takagi, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 945 days.

(21) Appl. No.: 13/071,988

(22) Filed: Mar. 25, 2011

(65) Prior Publication Data

US 2011/0236083 A1 Sep. 29, 2011

(30) Foreign Application Priority Data

Mar. 29, 2010 (JP) ..... 2010-075765

(51) Int. Cl.
*G03G 15/20* (2006.01)

(52) U.S. Cl.
CPC ..... *G03G 15/2075* (2013.01)
USPC ..... 399/327

(58) Field of Classification Search
CPC ..... G03G 15/2025; G03G 15/2075
USPC ..... 399/123, 327
See application file for complete search history.

(56) References Cited

U.S. PATENT DOCUMENTS 4,939,552 A * 7/1990 Nakanishi ..... 399/352
7,283,780 B2 10/2007 Uchida et al.
7,512,370 B2 3/2009 Shimizu et al.
7,599,637 B2 10/2009 Nanataki et al.
7,865,102 B2 1/2011 Nanataki et al.
2004/0247351 A1* 12/2004 Pirwitz et al. ..... 399/327
2010/0232849 A1 9/2010 Nanataki et al.

FOREIGN PATENT DOCUMENTS

JP 4-188177 7/1992
JP 10-171289 6/1998
JP 11-24484 1/1999
JP 2004-37556 2/2004
JP 2011209444 A * 10/2011

* cited by examiner

*Primary Examiner* — David Gray
*Assistant Examiner* — Ruth Labombard
(74) *Attorney, Agent, or Firm* — Fitzpatrick, Cella, Harper & Scinto

(57) ABSTRACT

A fixing apparatus for fixing a toner image formed on a recording material includes a rotatable member; a cleaning unit for cleaning the rotatable member, the cleaning unit including a cleaning fabric for cleaning the rotatable member, a feeding roller on which the cleaning fabric is wound, and a winding-up roller for winding up the cleaning fabric fed from the feeding roller; and a load applying mechanism for applying a retarding force against a winding-up operation of the winding-up roller such that when a frictional force between the rotatable member and the cleaning fabric which is in a standstill state and which is in contact with the rotatable member which is rotating exceeds the retarding force of the load applying mechanism, the winding-up roller rotates to wind up the cleaning fabric.

4 Claims, 5 Drawing Sheets

FIXING APPARATUS PROVIDED WITH CLEANING UNIT USING CLEANING FABRIC

FIELD OF THE INVENTION AND RELATED ART

The present invention relates to a fixing apparatus employable by an image forming apparatus, such as a copying machine, a laser beam printer, a facsimile machine, a multifunction image forming apparatus, etc., to fix a toner image. A multifunction image forming apparatus is an image forming apparatus capable of performing a combination of the functions of the preceding examples of an image forming apparatus, etc. A fixing apparatus is used, as necessary, with an image formation process, such as an electrophotographic process, an electrostatic recording process, a magnetic recording process, etc., in which an unfixed toner image, which is in accordance with the formation of an image to be formed, is formed on a sheet of recording medium, through direct or indirect transfer, with the use of toner made up of thermally meltable resin, etc. More specifically, a fixing apparatus is an apparatus for permanently fixing an unfixed toner image on a sheet of recording medium to the sheet of recording medium by heating the unfixed toner image. The recording medium usable with a fixing apparatus is recording paper, printing paper, transfer sheet, OHT sheet, glossy paper, glossy film, electro-facsimile paper, electrostatic recording paper, etc.

Generally, an image forming apparatus has such a fixing apparatus that uses heat and pressure to fix an unfixed toner image on a sheet of recording medium to the sheet. Generally, a fixing apparatus such as the one described above has a fixation roller and a pressure roller, which form a fixation nip by being pressured upon each other. In operation, it feeds a sheet of recording medium, on which an unfixed toner image is present, into the fixation nip, and conveys the sheet through the fixation nip while applying heat and pressure to the sheet of recording medium and the toner image thereon, so that the unfixed toner image becomes fixed to the sheet of recording medium.

A fixing apparatus, such as the one described above, suffers from the following phenomenon (problem): As a fixing apparatus is continuously used for image formation for a substantial length of time, some of the toner particles of which the toner image on the sheet of recording medium is made up of, transfer onto the peripheral surface of the fixation roller and remain adhered thereto. This phenomenon is caused by the deterioration of the properties of the peripheral surface of the fixation roller, static electricity, and/or excessiveness or insufficiency in the amount by which heat is given to the sheet of recording medium from the fixation roller. This phenomenon is likely to occur when the temperature of the fixation roller is significantly higher or lower than the proper level. Further, the amount by which toner is transferred onto the fixation roller is greater when the temperature of the fixation roller is significantly higher or lower. The toner particles having adhered to the peripheral surface of the fixation roller contaminate the recording medium by transferring back onto the recording medium in the fixation nip.

Thus, in order to prevent the above described contamination of the recording medium, a fixing apparatus is provided with a web-based cleaning apparatus for removing the toner particles on the peripheral surface of the fixation roller, by rubbing the peripheral surface of the fixation roller with its cleaning web.

FIG. 6 shows a conventional web-based cleaning apparatus. Designated by a referential code 131 is a fixation roller, which has a heater 133 in its hollow. A cleaning web 140 is held by a feed roller 142, a contact roller 130, and a wind-up or take-up roller 141, being stretched between the feed roller 142 and take-up roller 141. The contact roller 130 is kept pressed upon the peripheral surface of the fixation roller 131 by a spring 150 as a pressure applying means, creating thereby a cleaning nip N, with the presence of the cleaning web 140 between the fixation roller 131 and contact roller 130. That is, the portion of the cleaning web 140, which is in the cleaning nip N, provides the cleaning apparatus with a cleaning surface. The toner particles on the peripheral surface of the fixation roller 131 are wiped away (collected or recovered) by the portion of the cleaning web 140, which is in the cleaning nip N.

However, as the amount of the recovered (collected) toner (amount of toner on peripheral surface of fixation roller 131) increases because of the continuation of an image forming operation, the cleaning surface of the cleaning web 140 becomes contaminated, gradually reducing the cleaning apparatus in performance in terms of the recovery of the toner from the fixation roller 131 to the cleaning web 140. Eventually, the contamination of recording medium occurs.

Recently, as one of the means for solving this problem, a cleaning apparatus which feeds the cleaning nip N with an unused portion of the cleaning web 140, with a preset timing, for example, for every preset length of fixation time, has come to be known (Japanese Laid-open Patent Application H11-24484). In the case of this cleaning apparatus, in order to feed its fixation nip N with an unused portion of its cleaning web 140, the take-up roller 141 is rotated by a preset amount (angle) with preset timing, based on such information as cumulative print count, cumulative number of revolution of the fixation roller, or the like.

If an anomaly, such as paper jam, occurs, a large amount of toner sometimes transfers onto the peripheral surface of the fixation roller 131, which results in the intrusion of a large amount of toner into the cleaning nip N. In such a case, the problem that the fixation roller 131 fails to be properly cleaned, and/or abnormal noises are caused by the "slip-and-stick" between the fixation roller 131 and cleaning web 140. As for the countermeasure for this problem, there has been known a cleaning apparatus which is controlled in such a manner that if an anomaly such as paper jam is detected, an unused portion of the cleaning web is fed into the cleaning nip N by a length longer than the normal length by which it is fed when an on-going image forming operation is normal, in anticipation of the contamination of the peripheral surface of the fixation roller 131 by a greater amount.

The art described in Japanese Laid-open Patent Application H11-24484 is about a predicative control for taking up the cleaning web for every preset length of fixation time. Therefore, a cleaning web is conveyed by a preset length even if the amount by which toner is recovered in the cleaning nip N is small, and therefore, the cleaning surface of the cleaning web is not contaminated much. Therefore, a cleaning web roll has to be increased in the length of cleaning web in order to ensure that the fixation roller is satisfactorily cleaned for a long time before the cleaning apparatus has to be supplied with a fresh cleaning web roll. In other words, the art in the aforementioned patent document is problematic in that it requires for a fixing apparatus to be large in size, which results in cost increase.

Further, it is a common practice to require a user to select a printing mode based on paper type, so that the temperature of the fixation roller is set to a level which is optimum for the proper fixation of a toner image to recording medium (selected paper). However, this set-up creates the following problem. That is, if the user selected a wrong print mode, that is, a mode which should not be selected (this selection will be referred to as mode selection error), the temperature of the fixation roller is sometimes set to a level which is seriously higher or lower than the proper level. For example, if an image formed on a sheet of cardboard is fixed in the normal mode for ordinary paper, the amount by which heat is supplied to the recording medium (cardboard) is insufficient, possibly causing a large amount of toner to be transferred from the recording medium onto the peripheral surface of the fixation roller (cold offset). On the contrary, if an image is printed on a sheet of ordinary paper in the cardboard mode, the amount by which heat is supplied to the recording medium (ordinary paper) from the fixing apparatus is excessive, possibly causing a large amount of toner to be transferred onto the fixation roller (hot offset). In the abovementioned cases, it is liable that a large amount of toner having transferred onto the peripheral surface of the fixation roller enters the cleaning nip N.

In the case of the mode selection error described above, however, it is unlikely for an anomaly of this type to be detected, and therefore, the cleaning nip N is not fed with an unused portion of the cleaning web as it is if the mode selection error is not made. Therefore, it occurs sometimes that the fixation roller is poorly cleaned, and/or abnormal noises are generated by the "slip-and-stick" between the peripheral surface of the fixation roller and the cleaning web. Further, in some cases, the fixing apparatus is subjected to an excessive amount of internal stress, which results in the damages to the components, such as a motor, cleaning web, etc., of the fixing apparatus.

SUMMARY OF THE INVENTION

Thus, the primary object of the present invention is to provide a fixing apparatus which takes up the cleaning web by the length proportional to the amount of the contamination of the peripheral surface of the fixation roller.

According to an aspect of the present invention, there is provided a fixing apparatus for fixing a toner image formed on a recording material, said fixing apparatus comprising a rotatable member; a cleaning unit for cleaning said rotatable member, said cleaning unit including a cleaning fabric for cleaning said rotatable member, a feeding roller on which said cleaning fabric is wound, and a winding-up roller for winding up said cleaning fabric fed from said feeding roller; and a load applying mechanism for applying a retarding force against a winding-up operation of said winding-up roller such that when a frictional force between said rotatable member and said cleaning fabric which is in a standstill state and which is in contact with said rotatable member which is rotating exceeds the retarding force of said load applying mechanism, said winding-up roller rotates to wind up said cleaning fabric.

These and other objects, features, and advantages of the present invention will become more apparent upon consideration of the following description of the preferred embodiments of the present invention, taken in conjunction with the accompanying drawings.

Figure 1:
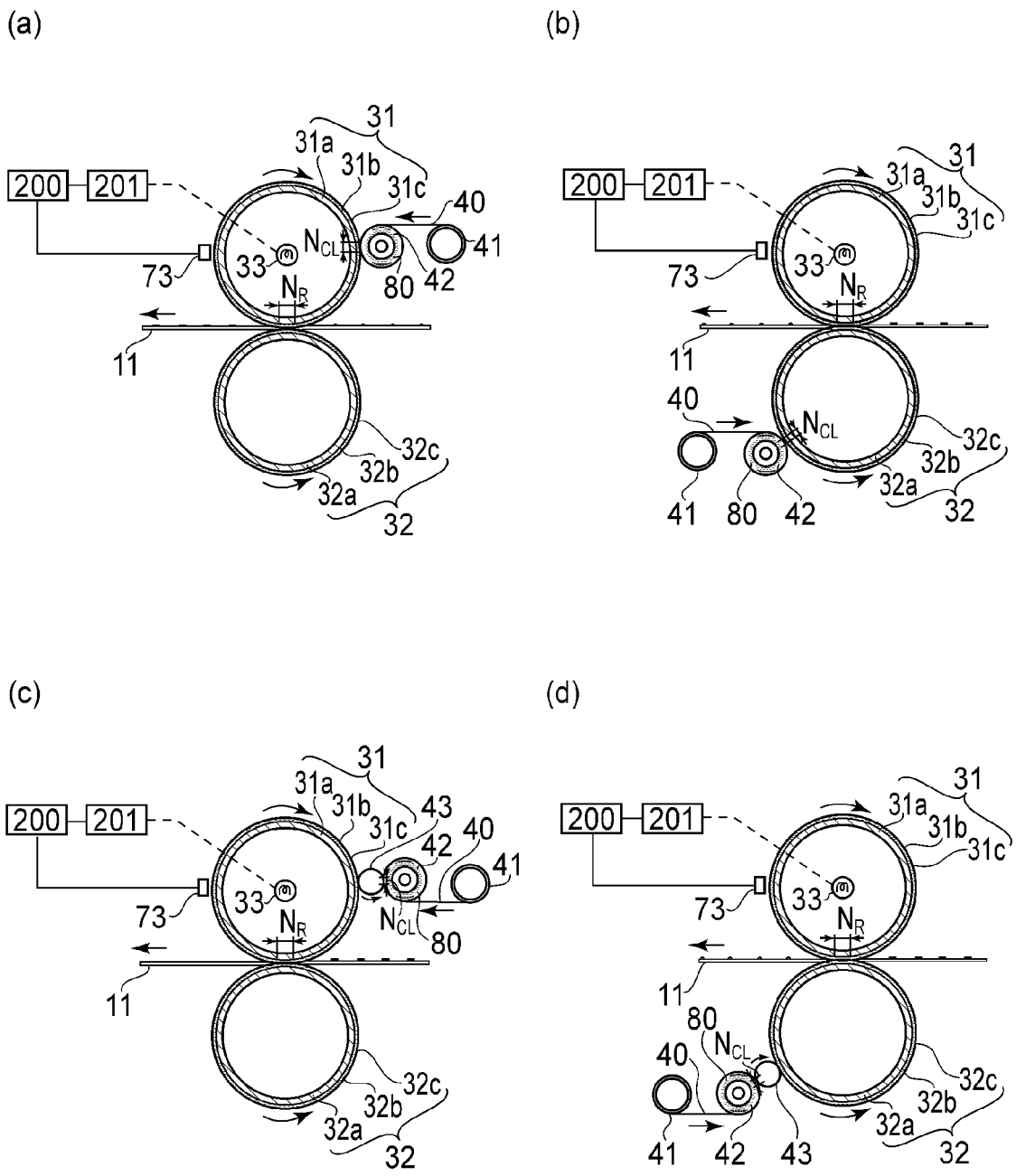
FIG. 1 is a schematic sectional view of the fixing apparatus in the first preferred embodiment of the present invention, and shows the general structure of the fixing apparatus.

Part (a) of FIG. 1 is a schematic sectional view of a fixing apparatus of this embodiment.

Part (b) of FIG. 1 is a schematic section view of modified example 1 of the fixing apparatus shown in part (a) of FIG. 1.

Part (c) of FIG. 1 is a schematic sectional view of modified example 2 of the fixing apparatus shown in part (a) of FIG. 1.

Part (d) of FIG. 1 is a schematic section view of modified example 3 of the fixing apparatus shown in part (a) of FIG. 1.

Figure 2:
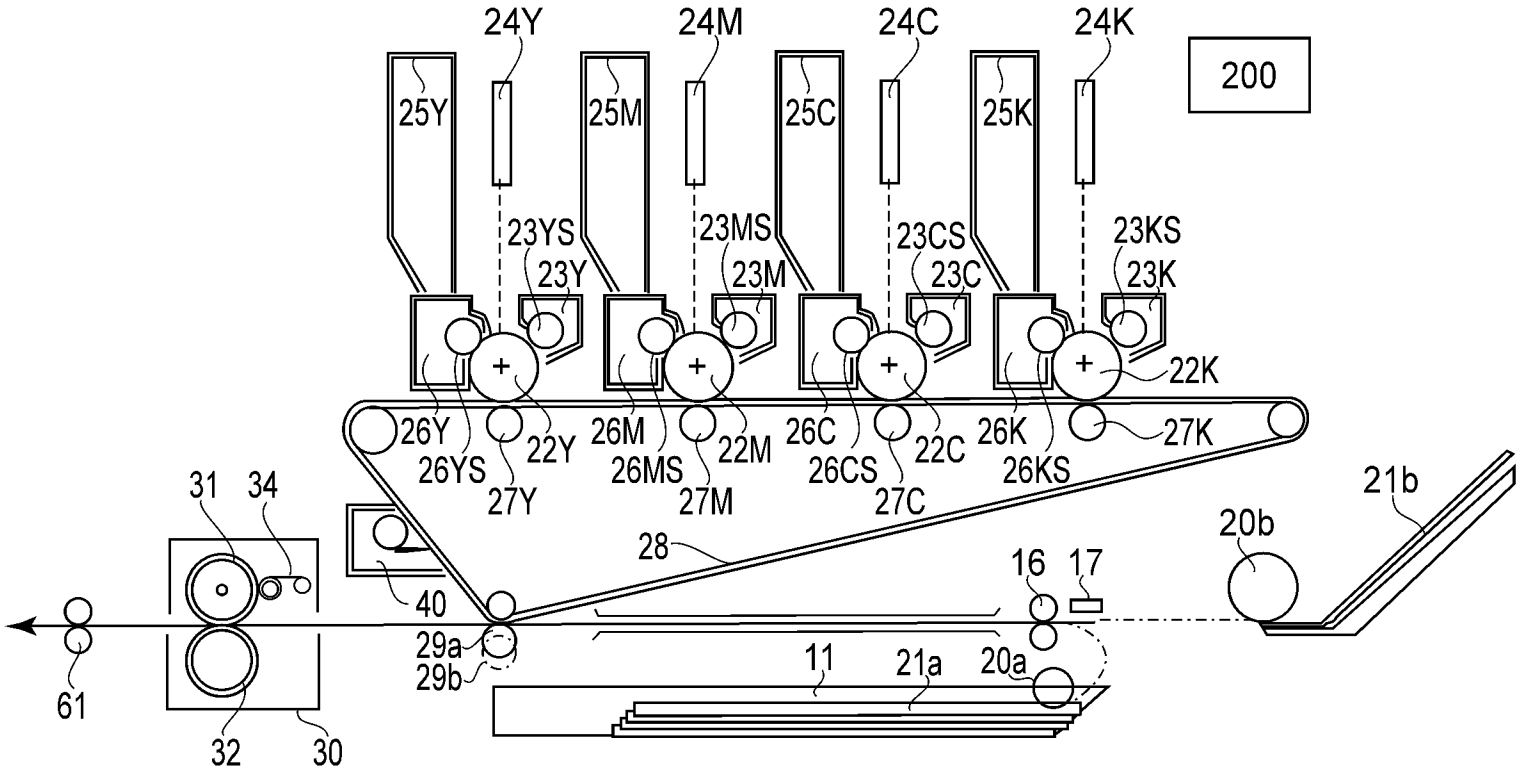

FIG. 2 is a schematic sectional view of the image forming apparatus in the first preferred embodiment of the present invention, and shows the general structure of the image forming apparatus.

Figure 3:
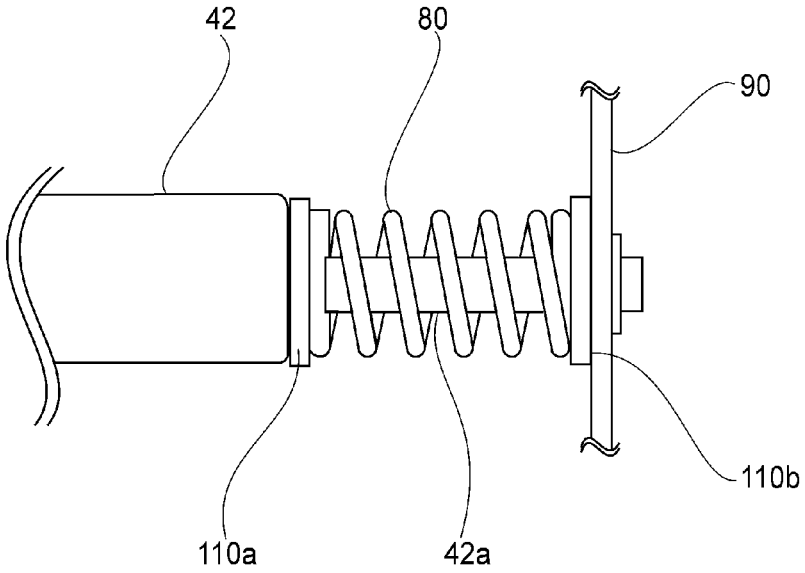

FIG. 3 is a drawing of the load applying member in the first preferred embodiment of the present invention.

Figure 4:
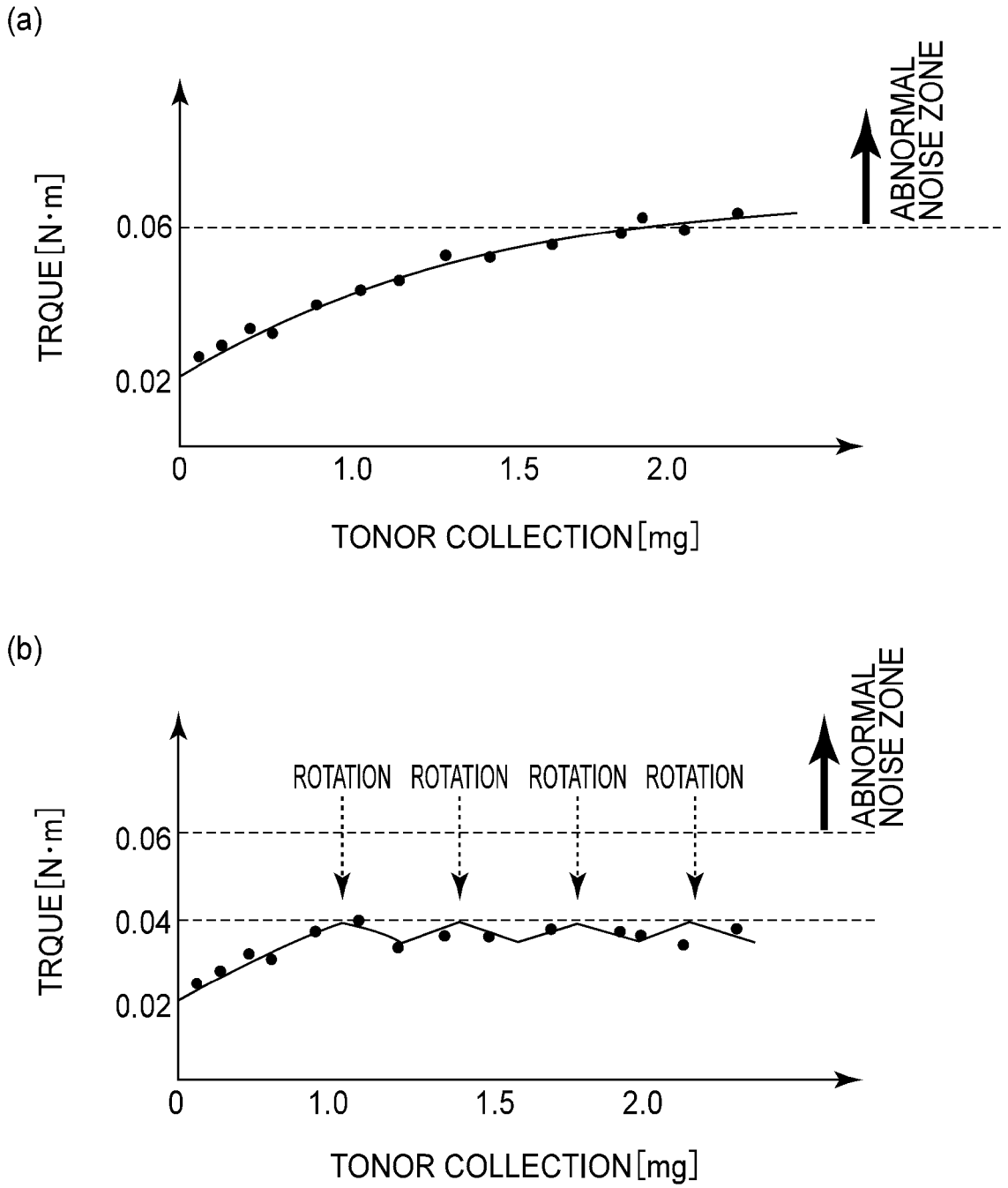

FIG. 4 is a drawing (graph) for showing the relationship between the amount of the recovered toner in the cleaning nip $N_{CL}$, and the amount of torque to which the shaft of the take-up roller was subjected. FIG. 4(*a*) shows the relationship between the amount of the toner recovered by the take-up roller 42 (cleaning web 40) and the torque of the shaft 42*a* of the take-up roller 42, when the take-up roller 42 was kept absolutely stationary. FIG. 4(*b*) shows the relationship between the amount of the recovered toner on the portion of the cleaning web 40 in the cleaning nip $N_{CL}$, and the amount of the torque applied to the shaft 42*a* of the take-up roller 42, when the take-up roller 42 was not kept absolutely stationary.

Figure 5:
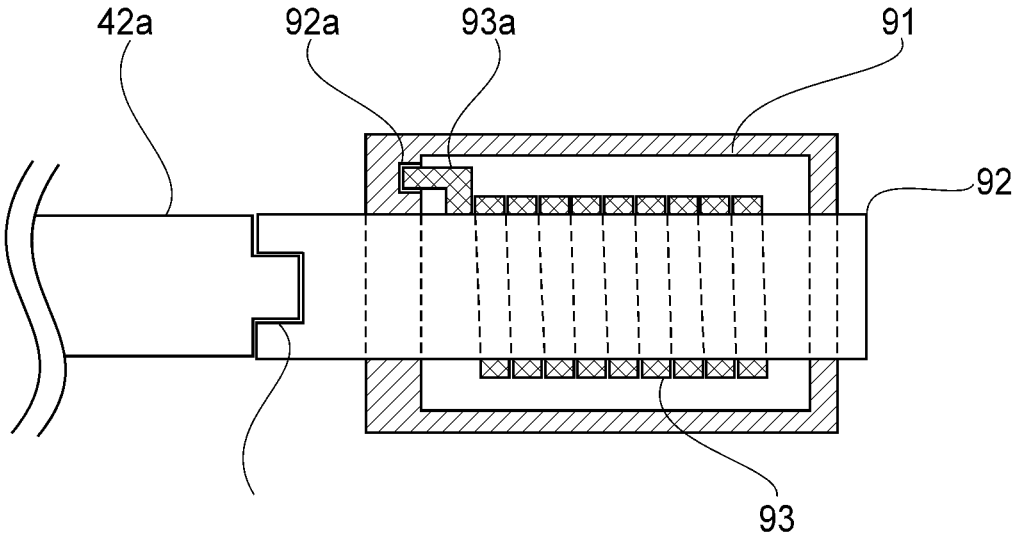

FIG. 5 is a schematic sectional view of the torque limiter in the second preferred embodiment of the present invention, and shows the structure of the torque limiter.

Figure 6:
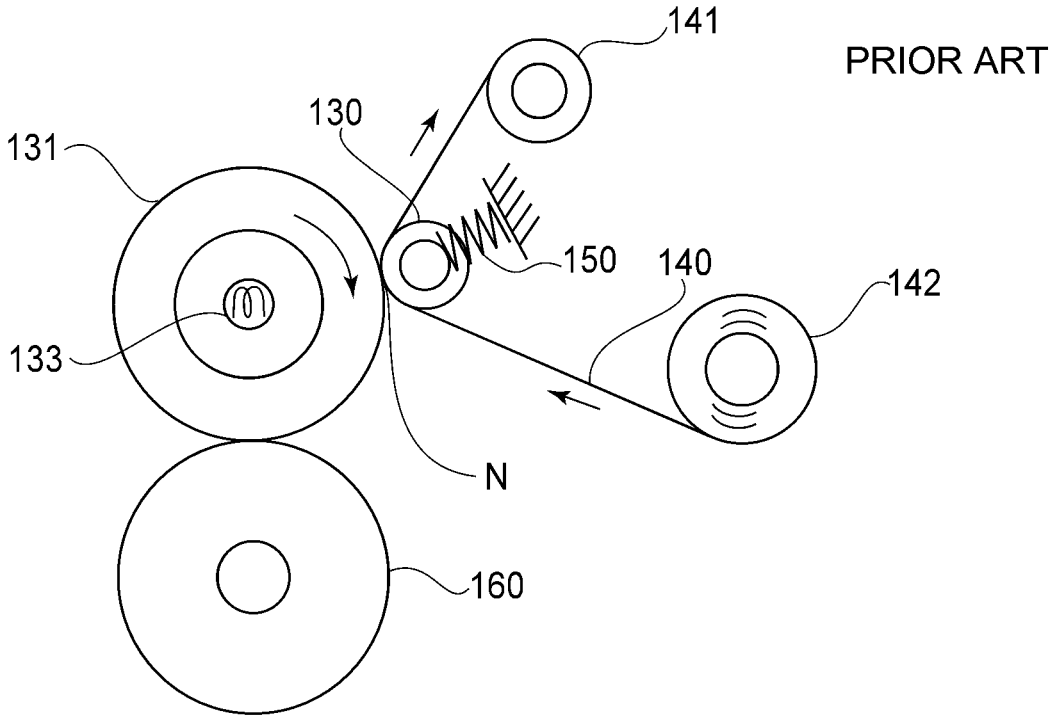

FIG. 6 is a schematic sectional view of a typical conventional fixing apparatus, and shows the structure of the conventional fixing apparatus.

DESCRIPTION OF THE PREFERRED EMBODIMENTS

Hereinafter, the preferred embodiments of the present invention are described in detail with reference to the appended drawings. Incidentally, the dimensions and materials of the structural components of the image forming apparatus, and the positional relationship among the structural components, in the following preferred embodiments of the present invention, are not intended to limit the present invention in scope, unless specifically noted.

Embodiment 1

(Image Forming Apparatus)

First, referring to FIG. 2, which shows the image forming portions of the image forming apparatus in this embodiment, the image forming portions is described with respect to its operation.

Each image forming portion forms an electrostatic latent image with the use of a beam of exposure light which is turned on and off with intervals which correspond to the length of the exposure time obtained by the image processing portion which converts the image formation data into image formation signals. Then, it forms a monochromatic image of toner by developing the electrostatic latent image. Monochromatic images, different in color, made of toner (which hereafter is referred to simply as toner image), are layered in alignment, effecting thereby a multicolor toner image (unfixed). The unfixed multicolor toner image is transferred onto a sheet of recording medium. Then, the unfixed multicolor toner image on the sheet of recording medium is fixed. The operation of each image forming portion is controlled by a CPU 200. Photosensitive drums 22Y, 22M, 22C, and 22K, which are photosensitive members are in the stations for forming yellow (Y), magenta (M), cyan (C), and black (K) monochromatic images, respectively. Each of the photosensitive drums 22Y, 22M, 22C, and 22K is made of an aluminum cylinder, and an organic photoconductive layer coated on the peripheral surface of the cylinder. It is rotated in the counterclockwise direction by the force transmitted to the drum 22 from an unshown motor, in synchronism with the progression of an image forming operation.

The four image forming stations are provided with four charging devices 23Y, 23M, 23C, and 23K, respectively, which are first charging means. The four charging devices 23Y, 23M, 23C, and 23K have charging sleeves 23YS, 23MS, 23CS, and 23KS, respectively, which charge the photosensitive drums 22Y, 22M, 22C, and 22K, respectively.

After the charging of the photosensitive drums 22Y, 22M, 22C, and 22K by the corresponding charging devices, one for one, four beams of exposure light are sent to them from four scanners 24Y, 24M, 24C, and 24K, respectively, selectively exposing the points (pixels) of the charged peripheral surface of each photosensitive drum 22. Consequently, an electrostatic latent image is effected on the peripheral surface of each photosensitive drum 22.

The four image forming stations are also provided with four developing devices 26Y, 26M, 26C, and 26K for developing the four electrostatic latent images, one for one, with the use of four toners, one for one, different in color. The four developing devices 26Y, 26M, 26C, and 26K have four sleeves 26YS, 26MS, 26CS, and 26KS, respectively. The normal polarity to which the four toners used in this embodiment become charged is negative. Between the sleeves 26YS, 26MS, 26CS, and 26KS, and photosensitive drums 22Y, 22M, 22C, and 22K, respectively, development bias is applied from an unshown electric power source. By this development bias, four monochromatic toners, different in color, are supplied from the developing devices onto the corresponding photosensitive drums, forming thereby four monochromatic toner images on the four photosensitive drums 22, one for one. The four developing devices 26 are independently and removably mountable in the image forming apparatus.

During the formation of a color image forming operation, the intermediary transferring member 28 is in contact with the photosensitive drums 22Y, 22M, 22C, and 22K, and is rotated in the clockwise direction, at the same velocity as the peripheral velocity of each photosensitive drum 22, so that the monochromatic toner images are transferred onto the intermediary transfer member 28. More concretely, the first transfer bias is applied between the first transfer rollers 27Y, 27M, 27C, and 27K, and corresponding photosensitive drums 22Y, 22M, 22C, and 22K, respectively. Thus, the four monochromatic toner images, different in color, are transferred from the intermediary transfer member 28 by the first transfer bias, in such a manner that the four monochromatic toner images, different in color, are sequentially layered on the intermediary transfer member 28 in alignment with each other. Consequently, a multicolor toner image is formed on the intermediary transfer member 28.

The sheet feeding portion, which is a sheet feeding means, has a sheet feeder cassette 21*a* and a sheet feeder tray 21*b*. The sheet feeding portion holds multiple sheets 11 of recording medium in layers. The multiple sheets 11 of recording medium are fed one by one into the main assembly of the image forming apparatus by a pair of sheet feeder rollers 20*a* and 20*b*, and sent to a pair of registration rollers 16. As each sheet 11 of recording medium reaches the pair of registration rollers 16, its arrival at the rollers 16 is detected by a sensor 17 which is on the upstream side of the rollers 16 in terms of the sheet conveyance direction. During an image forming operation, as the sheet 11 arrives at the registration rollers 16, it is held there for a preset length of time by the rollers 16, and then, is released by the rollers 16 with such a timing that the sheet 11 will arrive at a second transfer roller 29 at the same time as the arrival of the multicolor toner image at the second transfer roller 29.

The second transfer roller 29 is in contact with the intermediary transfer member 28. As the sheet 11 of recording medium arrives at the roller 29, the roller 29 transfers the multicolor toner image from the intermediary transfer member 28 onto the sheet 11 of recording medium while conveying the sheet 11 by keeping the sheet 11 pinched between itself and intermediary transfer member 28. Then, the sheet 11 is sent from the second transfer roller 29 to the fixing apparatus 30 which is an image heating apparatus. While the second transfer roller 29 is transferring the multicolor toner image onto the sheet 11 of recording medium, it is kept in the position 29*a* in which it pressed on the sheet 11. However, as soon as the image forming operation ends, the second transfer roller 29 is moved back to the position 29*b* where the second transfer roller 29 is kept separated from the intermediary transfer member 28. Further, during an image forming operation, the second transfer bias is applied between the second transfer roller 29 and intermediary transfer member 28 from an unshown electric power source. It is by the second transfer bias that the multicolor toner image is transferred from the intermediary transfer member 28 onto the sheet 11 of recording medium.

The fixing apparatus 30 is an apparatus that fixes the unfixed multicolor toner image on the sheet 11 of recording medium to the sheet 11 by melting the multicolor toner image with the application of heat thereto, while conveying the sheet 11 through the fixing apparatus 30. It is made up of a pair of sheet conveying rollers, that is, a fixation roller 31 and a pressure roller 32. The pressure roller 32 is kept pressed upon the fixation roller 31. The sheet 11 of recording medium on which the unfixed multicolor toner image is present is conveyed through the fixation nip which the fixation roller 31 and pressure roller 32 form. As it is conveyed through the fixation nip, heat and pressure are applied to the sheet 11 and the multicolor toner image thereon, whereby the multicolor toner image is fixed to the surface of the sheet 11. Then, the sheet 11 is conveyed to a pair of discharge rollers 61. The contaminants on the peripheral surface of the fixation roller 31 are removed by the web-based cleaning apparatus 34.

The structure of the fixing apparatus 30 is described later.

The discharge rollers 61 discharge the sheet 11 of recording medium into an unshown delivery tray, and the image forming portions end the above described image formation sequence.

The recording medium sheet conveyance speed in this embodiment is 40 mm/sec.

(Fixing Apparatus)

FIG. 1(*a*) is a sectional view of the fixing apparatus in this embodiment, and shows the basic structure of the apparatus. The fixation roller 31 is made up of a substrate 31*a*, an elastic layer 31*b*, and a surface layer 31*c*. The substrate 31*a* is metallic, and is the core of the fixation roller 31. It is a hollow iron cylinder, and is 1.5 mm in wall thickness. The elastic layer 31*b* is a silicon rubber layer, and covers virtually the entirety of the peripheral surface of the metallic (iron) core 31*a*. It is 2 mm in thickness. The surface layer 31*c*, which is a parting layer, is made of fluorinated resin. It covers the entirety of the peripheral surface of the elastic layer 31*b*. It is 50 μm in thickness. The external diameter of the fixation roller 31 is 35 mm. One of the end portions of the metallic core 31*a* is fitted with a gear (unshown), through which the force for rotating the fixation roller 31 is transmitted to the fixation roller 31 from a fixation roller driving motor 50 as the fixation roller driving means. The fixation roller 31 is rotated by this force. The basic structure of the pressure roller 32 is the same as that of the fixation roller 31. That is, the pressure roller 32 is made up of a substrate 32*a*, an elastic layer 32*b*, and a surface layer 32*c*. The substrate 32*a* is metallic, and is the core of the pressure roller 32. It is a hollow iron cylinder and is 1.5 mm in thickness. The elastic layer 32*b* is a silicon rubber layer, and covers virtually the entirety of the peripheral surface of the metallic (iron) core 32*a*. It is 2 mm in wall thickness. The surface layer 32*c*, which is a parting layer, is made of fluorinated resin. It covers the entirety of the peripheral surface of the elastic layer 32*b*. It is 50 μm in thickness. The external diameter of the pressure roller 32 is 35 mm, which is the same as that of the fixation roller 31. The pressure roller 32 is kept pressed upon the fixation roller 31 by roughly 400 N of pressure generated by a combination of unshown springs and supporting members, forming thereby a heating nip $N_F$ between its peripheral surface and the peripheral surface of the fixation roller 31. The heating nip $N_F$ is for fixing the multicolor toner image on the sheet 11 of recording medium, to the surface of the sheet 11 by melting the image with the application of heat.

A halogen heater 33 is the heat source for heating the fixation roller 31, and is in the hollow of the fixation roller 31. The surface temperature of the fixation roller 31 is detected by a thermopile 73, which is a noncontact temperature detecting means, and is positioned so that it faces the peripheral surface of the fixation roller 31. The detected surface temperature of the fixation roller 31, which is in the form of an analogue signal, is converted into a digital signal by the CPU 200 (A/D conversion). The CPU 200 keeps the surface temperature of the fixation roller 31 at a preset level by controlling (turning on or off) an electric power circuit 201, which is the means for supplying the halogen heater 33 with electric power, based on the detected surface temperature of the fixation roller 31.

(Web-Based Cleaning Apparatus (Cleaning Unit))

Next, the web-based cleaning unit 34, which is the cleaning apparatus in this embodiment, is described. A cleaning web 40, which is the cleaning cloth, is an unwoven cloth made of aramid fiber. The cleaning web 40 is kept stretched between a supply roller 41 and a take-up roller 42, and is kept pressed upon the peripheral surface of the fixation roller 31 by 4.9 N of pressure applied by the take-up roller 42 by which the cleaning web 40 is taken up. The cleaning web 40 removes the contaminants on the peripheral surface of the fixation roller 31, by its portion which is kept pressed upon the peripheral surface of the fixation roller 31 by the take-up roller 42. Hereafter, the area of contact between the fixation roller 31 and cleaning web 40 is referred to as a cleaning nip $N_{CL}$. That is, the portion of the cleaning web 40, which is in the cleaning nip $N_{CL}$, provides the cleaning apparatus with the cleaning surface, which faces the peripheral surface of the fixation roller 31. In this embodiment, the dimension of the cleaning nip $N_{CL}$ in terms of the rotational direction of the fixation roller 31 is 2.0 mm. That is, the cleaning web 40 cleans the peripheral surface of the peripheral surface of the fixation roller 31 (which is one of the pair of recording medium sheet conveyance rollers), by wiping the peripheral surface of the fixation roller 31 with its cleaning surface, that is, the portion of the cleaning web 40, which is in the cleaning nip $N_{CL}$.

The cleaning web 40 in this embodiment is moved by the friction between itself and the peripheral surface of the fixation roller 31, which increases as the amount of the toner on its cleaning surface increases. Thus, as the cleaning surface of the cleaning web 40, which is in the cleaning nip $N_{CL}$, becomes significantly contaminated, it is replaced by the immediately upstream portion of the cleaning web 40 in terms of the rotational direction of the fixation roller 31. The cleaning apparatus 34 in this embodiment is structured so that the take-up roller 42 is kept pressed against the fixation roller 31, with the presence of the cleaning surface of the cleaning web 40 between the take-up roller 42 and fixation roller 31, and takes up the cleaning web 40 as the portion of the cleaning web 40, which is in the cleaning nip $N_{CL}$, is moved out of the cleaning nip $N_{CL}$ by the interaction between the rotation of the fixation roller 31 and the friction between the cleaning web 40 and peripheral surface of the fixation roller 31. More specifically, as the amount of the toner on the cleaning surface exceeds a certain value, the portion of the cleaning web 40, which is in the cleaning nip $N_{CL}$, is moved downstream out of the cleaning nip $N_{CL}$ by the rotation of the fixation roller 31. As the portion of the cleaning web 40, which is in the cleaning nip $N_{CL}$ is moved out of the cleaning nip $N_{CL}$, the take-up roller 42 rotates in the direction to take up the cleaning web 40. Further, as the cleaning web 40 is moved by being pulled by the rotation of the fixation roller 31, the supply roller 41 rotates by being pulled by the cleaning web 40. In other words, the portion of the cleaning web 40, which is on the supply roller 41, is unrolled from the supply roller 41 while allowing its portion in the cleaning nip $N_{CL}$ to be moved out downward from the cleaning nip $N_{CL}$. The supply roller 41 and take-up roller 42 are 8 mm in external diameter. The width (dimension in terms of direction perpendicular to recording medium conveyance direction) is 224 mm. The take-up roller 42 is placed in contact with, or separated from, the fixation roller 31 with a preset timing by an unshown take-up roller moving mechanism.

In this embodiment, the web-based cleaning apparatus 34 is positioned so that it is placed in contact with the fixation roller 31. However, the web-based cleaning apparatus 34 may be positioned so that it is placed in contact with the pressure roller 32 as shown in FIG. 1(*b*). In such a case, the area of contact between the pressure roller 32 and cleaning web 40 is the cleaning nip $N_{CL}$, and the portion of the cleaning web 40, which is in the cleaning nip $N_{CL}$ is the cleaning portion of the cleaning web 40. The surface of this portion of the cleaning web 40, which is facing the peripheral surface of the pressure roller 32 is the cleaning surface. Also in such a case, the pressure roller 32 is equivalent to one of the recording medium conveying rollers in accordance with the present invention. Further, the fixing apparatus 30 may be provided with a roller 43 which is in contact with the fixation roller 31 or pressure roller 32, and the cleaning web 40 may be placed in contact with the roller 43, as shown in FIGS. 1(*c*) and 1(*d*). As the roller 43, that is, the roller which is placed in contact with the fixation roller 31 or pressure roller 32, there is a first recovery roller, an external heat roller, etc. A first recovery roller is such an auxiliary cleaning roller that is pressed upon the surface of a fixing member for temporarily recovering the contaminants on the surface of the fixing member while being rotated. The contaminants recovered by the auxiliary cleaning roller (first recovery: temporary recovery) are recovered by the cleaning web (second recovery: permanent recovery). An external heat roller is such a heat roller that has an internal or external heat source and rotates while being kept pressed upon the fixing member. It heats the fixing member from the outward surface side of the fixing member. Thus, in a case where the roller 43 is employed, the area of contact between the roller 43 and cleaning web 40 is the cleaning nip $N_{CL}$, and the portion of the cleaning web 40, which is in the cleaning nip $N_{CL}$, cleans the surface of the fixing member. Also in this case, the surface of this portion, which is facing the peripheral surface of the roller 23, is the cleaning surface, and the roller 43 is equivalent to one of the recording medium conveying rollers in accordance with the present invention.

(Load Applying Member)

FIG. 3 shows the load applying member in this embodiment which is a load applying mechanism. The load applying rotational member in this embodiment applies load to the take-up roller 42 in such a manner that the load works in the direction to prevent the rotation of the shaft 42*a* of the take-up roller 42 which is rotated by the movement of the cleaning web 40 as the portion of the cleaning web 40, which is in the cleaning nip $N_{CL}$ is moved out of the nip $N_{CL}$. The load applying rotational member has a compression spring 80 and a pair of silicon plates 110*a* and 110*b* (friction plates). The compression spring 80 is made up of SUS304. It is 8 mm in external diameter, and 0.8 in wire diameter. It is fitted around the shaft 42*a* of the take-up roller 42, and is kept compressed between one of the end surfaces of the take-up roller 42 and the side plate 90 of the fixing apparatus frame. Since the compression spring 80 is kept compressed, it keeps the take-up roller 42 pressed in the direction to move the take-up roller 42 away from the side plate 90.

Further, the load applying rotational member has two pieces 110*a* and 110*b* of silicon rubber, which are 1 mm in thickness. The silicon rubber piece 110*a* is between one of the lengthwise ends of the compression spring 80 and the corresponding end surface of the take-up roller 42, and is solidly glued to the lengthwise end surface of the take-up roller 42. The silicon rubber piece 110*b* is between the other end of the compression spring 80 and the side plate 90, and is solidly glued to the side plate 90.

Therefore, the torque (rotational force) with which the shaft 42*a* of the take-up roller 42 is provided, and works in the direction to make the take-up roller 42 take up the cleaning web 40, is subjected to the friction generated between the silicone rubber piece 110*a* and the end surface of the take-up roller 42 by the resiliency of the compression spring 80, and the friction generated between the silicone rubber piece 110*b* and the side plate 90 also by the resiliency of the compression spring 80. Thus, as the fixation roller 31 rotates, the friction is generated between the two silicone rubber pieces 110*a* and 110*b* and corresponding surfaces. This friction functions as the load which is against the friction which is generated between the cleaning surface and the peripheral surface of the fixation roller 31 and increases as the amount of toner on the cleaning surface increases. Thus, when the torque with which the shaft 42*a* of the take-up roller 42 is provided by the friction between the cleaning surface of the cleaning web 40 and the peripheral surface of the fixation roller 31 is no more than roughly 0.04 N·m (no more than threshold value), the take-up roller 42 is prevented from rotating; the take-up roller 42 rotates only when the torque of the shaft 42*a* is no less than 0.4 N·m. The torque of the shaft 42*a* of the take-up roller 42, which is roughly 0.04 N·m, corresponds to the threshold value preset for the friction between the peripheral surface of the fixation roller 31 and the cleaning surface, which increases with the increases in the amount of toner on the cleaning surface of the cleaning web 40. Therefore, when the torque of the shaft 42*a* of the take-up roller 42 is no more than roughly 0.04 N·m, the take-up roller 42 is prevented by the friction generated by the silicone rubber pieces 110*a* and 110*b* from rotating. However, as the torque of the shaft 42*a* of the take-up roller 42 becomes no less than roughly 0.04 N·m, becoming therefore greater than the friction generated by the silicone rubber pieces 110*a* and 110*b*, the take-up roller 42 rotates.

As described above, the cleaning unit in this embodiment has the load applying mechanism (80, 110*a*, and 110*b*) which functions as a brake for regulating the rotation of the take-up roller 42 for taking up the cleaning web 40 (cleaning cloth). That is, as the friction between the peripheral surface of the rotational member 31, and the portion of the cleaning web 40 (cleaning cloth), which is remaining stationary in the cleaning nip $N_{CL}$, becomes greater than the friction (retarding or braking force) generated by the load applying mechanism, the take-up roller 42 is rotated by the friction between the peripheral surface of the fixation roller 31 and the cleaning surface, in the direction to take up the cleaning web 40 (cleaning cloth).

In FIG. 4, (a) shows the relationship between the amount of the toner recovered by the take-up roller 42 (cleaning web 40) and the torque of the shaft 42*a* of the take-up roller 42, when the take-up roller 42 was kept absolutely stationary, and therefore, the cleaning nip $N_{CL}$ was not supplied with a fresh portion of the cleaning web 40. The amount of torque of the shaft 42*a* of the take-up roller 42 when the portion of the cleaning web 40 in the cleaning nip $N_{CL}$ was brand-new was roughly 0.02 N·m. However, as the amount of the recovered toner on the cleaning nip portion of the cleaning web 40 increased, the friction between the cleaning web 40 and the peripheral surface of the fixation roller 31 increased, increasing thereby the amount of torque applied to the shaft 42*a* of the take-up roller 42.

As the amount of torque applied to the shaft 42*a* of the take-up roller 42 became no less than roughly 0.06 N·m, the "slip-and-slick" occurred between the fixation roller 31 and the cleaning web 40, which sometimes resulted in the generation of such abnormal noises that were in 100-200 Hz in frequency, and/or unsatisfactory cleaning of the fixation roller 31 attributable to the reduction of the toner recovery capacity of the portion of the cleaning web 40 in the cleaning nip $N_{CL}$. As the amount of the toner applied to the shaft 42*a* of the take-up roller 42 was increased by the further increase of the amount of the recovered toner on the portion of the cleaning web 40 in the cleaning nip $N_{CL}$, the components of the fixing member were subjected to an excessive amount of stress; in some cases, the components of the fixing member were damaged.

FIG. 4(*b*) shows the relationship between the amount of the recovered toner on the portion of the cleaning web 40 in the cleaning nip $N_{CL}$, and the amount of the torque applied to the shaft 42*a* of the take-up roller 42, when the take-up roller 42 was not kept absolutely stationary. As the amount of the recovered toner on the portion of the cleaning web 40 in the cleaning nip $N_{CL}$ increased, the amount of the friction between the cleaning web 40 and the peripheral surface of the fixation roller 31 in the cleaning nip $N_{CL}$ also increased. However, as the amount of the torque exceeded 0.04 N·m, the take-up roller 42 rotated in such a direction that its peripheral surface moved in the same direction in which the peripheral surface of the fixation roller 31 moved, whereby a fresh portion of the cleaning web 40 was moved into the cleaning nip $N_{CL}$, reducing thereby the friction between the cleaning surface of the cleaning web 40 and the peripheral surface of the fixation roller 31. Thus, the amount of the torque applied to the shaft 42*a* of the take-up roller 42 reduced, preventing thereby the aforementioned problem that abnormal noises were generated by the "slip-and-stick" attributable to the increase in the amount of the friction between the cleaning web 40 and fixation roller 31; the fixation roller 31 fails to be properly cleaned; and/or the components of the fixing member were damaged. Further, as the cleaning nip $N_{CL}$ was supplied with a fresh portion of the cleaning web 40, the amount of the torque applied to the shaft 42*a* of the take-up roller 42 reduced, and therefore, the take-up roller 42 did not rotate. Thus, it did not occur that the cleaning nip $N_{CL}$ is unnecessary supplied with a fresh portion of the cleaning web 40.

As described above, in this embodiment, as the torque of the shaft 42*a* of the take-up roller 42, which is related to the amount of the recovered toner, exceeds a preset amount, that is, roughly 0.04 N·m, the cleaning nip $N_{CL}$ is supplied with a fresh portion of the cleaning web 40, by rotating the take-up roller 42 in such a direction that its peripheral surface moves in the same direction as the peripheral surface of the fixation roller 31 moves. Because of this structural arrangement, when the amount of the recovered toner is small, the take-up roller 42 is not rotated, and therefore, the cleaning nip $N_{CL}$ is not supplied with a fresh portion of the cleaning web 40. In other words, the employment of this embodiment of the present invention can reduce the amount of the cleaning web consumption. That is, it can significantly reduce the initial amount (length) by which the supplied roller 41 needs to be supplied with the cleaning web 40, compared to any of fixing apparatuses in accordance with the prior art, which is controlled in such a manner that the cleaning nip $N_{CL}$ is predicatively supplied with a preset amount (length) of cleaning web 40 per preset length of fixation time. Therefore, it can reduce a fixing apparatus in size and cost.

Next, a case in which a user selected a wrong recording medium mode is described. It is assumed here that the user selected the mode for ordinary paper when the mode for cardboard should have been selected. In such a case, the amount by which heat is supplied to the sheet 11 of recording medium is insufficient for cardboard, and therefore, a large amount of toner adheres (offsets from sheet 11 of recording medium) to the peripheral surface of the fixation roller 31, and reaches the cleaning nip $N_{CL}$. In the case of a fixing apparatus controlled so that its cleaning nip $N_{CL}$ is fed with a preset length of cleaning web 40 per preset length of fixation time, the friction between the cleaning web 40 and the peripheral surface of the fixation roller 31 in the cleaning nip $N_{CL}$ increases, increasing thereby the amount of the torque to which the shaft 42*a* of the take-up roller 42 is subjected. The conventional fixing apparatus, however, does not have a means for detecting the increase of the torque of the shaft 42*a*. Therefore, the problems that the fixation roller 31 failed to be properly cleaned; abnormal noises are generated by the "slip-and-stick"; and/or the components of the fixing apparatus are damaged, sometimes occurred.

In the case of the fixing apparatus in this embodiment, as the torque to which the shaft 42*a* of the take-up roller 42 is subjected is increased by the friction between the cleaning web 40 and the peripheral surface of the fixation roller 31 is increased by the recovered toner (toner wiped away from peripheral surface of fixation roller 31 by cleaning web 40) in the cleaning nip $N_{CL}$, the take-up roller 42 is automatically rotated in such a direction that its peripheral surface moves in the same direction as the direction in which the peripheral surface of the fixation roller 31 moves, and the cleaning nip $N_{CL}$ is supplied with a fresh portion of the cleaning web 40, preventing thereby the torque from increasing further. Therefore, the problems that the fixation roller 31 fails to be properly cleaned; abnormal noises are generated by the "slip-and-stick"; and/or components of the fixing apparatus are damaged, is unlikely to occur.

Embodiment 2

(Load Applying Member)

In this embodiment, a torque limiter is employed as a load applying member. Otherwise, the structure of the fixing apparatus in this embodiment is the same as that in the first embodiment, and therefore, is not described. Referring to FIG. 5, the torque limiter has an external cylinder 91, a shaft 92, and a coil spring 93. The coil spring 93 is in the hollow of the external cylinder 91, and is fitted around the shaft 92. One end of the shaft 92 has a recess 92*a* in which the shaft 42*a* of the take-up roller 42 fits. Therefore, it is ensured that the shaft 92 rotates with the shaft a of the take-up roller 42. One end 93*a* of the coil spring 93 is bent, and is fitted in the recess 91*a* of the external cylinder 91. Thus, in terms of the rotational direction of the fixation roller 31, the external cylinder 91 and the lengthwise end 9*a* of the coil spring 93 is not movable relative to each other. Further, the coil spring 93 regulates the rotation of the shaft 92 by squeezing on the shaft 92 by a preset amount of force. If the torque to which the shaft 92 is subjected is no more than 0.04 N·m, the coil spring 93 prevents the shaft 92 from rotating. On the other hand, if the torque is no less than 0.04 N·m, the torque causes the shaft 91 to rotate against the constraint from the coil spring 91. The external cylinder 91 of this torque limiter is attached to the side plate of the main assembly of the apparatus by an unshown external cylinder holding member so that the external cylinder 91 does not move relative to the side plate. Thus, it is only when the torque to which the shaft 42*a* of the take-up roller 42 is subjected is no less than 0.04 N·m that the take-up roller 42 rotates with the fixation roller 31. As the take-up roller 42 rotates with the fixation roller 31, the cleaning nip $N_{CL}$ is supplied with a fresh portion of the cleaning web 40, being thereby provided with a fresh cleaning surface.

In this embodiment, the employment of the above described torque limiter makes it possible to more precisely regulate the torque for rotating take-up roller 42 than in the first embodiment. Therefore, this embodiment is superior to the first embodiment in terms of the effectiveness and preciseness with which the torque can be regulated.

Incidentally, in the preceding preferred embodiments of the present invention, the shaft 42*a* of the take-up roller 42 was provided with the mechanical load applying member. However, the preceding embodiments are not intended to limit the present invention in scope. That is, it may be to any rotational shaft of the fixing apparatus that the mechanical load applying member is attached, as long as the shaft is in connection to the shaft 42*a* of the take-up roller 42, that is, the shaft to which the torque generated by the friction between the cleaning web and the peripheral surface of the fixation roller (or pressure roller) is to be transmitted. That is, regardless of which of the rotational shafts of the fixing apparatus is provided with the mechanical load applying member, the effects of the present invention remain the same as those obtained by the preceding embodiments.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 075765/2010 filed Mar. 29, 2010 which is hereby incorporated by reference.

What is claimed is:

1. A fixing apparatus for fixing a toner image on a recording material while conveying the recording material bearing the toner image at a nip portion, the fixing apparatus comprising:

a rotating member;

a back-up member forming the nip portion with the rotating member;

a cleaning unit configured to clean the rotating member, the cleaning unit including a cleaning fabric for cleaning the rotating member, a first roller on which an unused portion of the cleaning fabric is wound, and a second roller for winding up a used portion of the cleaning fabric and forming a pressure portion with the rotating member via the cleaning fabric; and a load applying mechanism configured to apply a rotational load on the second roller, wherein the second roller is rotated by a rotation of the rotating member while a friction force applied on the second roller at the pressure portion exceeds the rotational load, and the second roller is not rotated while the friction force is below the rotational load.

2. An apparatus according to claim 1, wherein the load applying mechanism includes a friction plate provided on an axial end of the second roller, and a spring mounted in a compressed state between the second roller and the friction plate.

3. An apparatus according to claim 1, wherein the load applying mechanism includes a torque limiter provided on an axial end of the second roller.

4. A fixing apparatus for fixing a toner image on a recording material while conveying the recording material bearing the toner image at a nip portion, the fixing apparatus comprising:

a rotating member;

a back-up member forming the nip portion with the rotating member;

a cleaning unit configured to clean the rotating member, the cleaning unit including a cleaning fabric for cleaning the rotating member, a first roller on which an unused portion of the cleaning fabric is wound, and a second roller for winding up an used portion of the cleaning fabric and forming a pressure portion with the rotating member via the cleaning fabric; and a load applying mechanism configured to apply a rotational load on the second roller;

wherein the second roller is rotated by a rotation of the rotating member according to a friction force applied on the second roller at the pressure portion.

* * * * *